US011505995B1

(12) United States Patent
Pachta et al.

(10) Patent No.: US 11,505,995 B1
(45) Date of Patent: Nov. 22, 2022

(54) AUTOMATIC DIGGING ADJUSTMENT SYSTEM AND METHOD

(71) Applicant: Altec Industries, Inc., Birmingham, AL (US)

(72) Inventors: Ryan M. Pachta, Parkville, MO (US); Timothy J. Mourlam, Shawnee, KS (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 17/550,386

(22) Filed: Dec. 14, 2021

(51) Int. Cl.
*E21B 7/02* (2006.01)
*E21B 10/44* (2006.01)
*E21B 7/04* (2006.01)

(52) U.S. Cl.
CPC ..... *E21B 7/023* (2013.01); *E21B 7/022* (2013.01); *E21B 7/04* (2013.01); *E21B 7/027* (2013.01); *E21B 10/44* (2013.01)

(58) Field of Classification Search
CPC ..... E21B 7/022; E21B 7/027; E21B 10/44
See application file for complete search history.

(56) References Cited

U.S. PATENT DOCUMENTS

| | | | | |
|---|---|---|---|---|
| 10,597,994 | B2 | 3/2020 | Allen et al. | |
| 2017/0009530 | A1* | 1/2017 | Homma | E21B 21/015 |
| 2019/0032466 | A1 | 1/2019 | Wilson et al. | |

* cited by examiner

*Primary Examiner* — Robert E Fuller
*Assistant Examiner* — Lamia Quaim
(74) *Attorney, Agent, or Firm* — Erise IP, P.A.

(57) ABSTRACT

A system and method for automatically digging a hole using a digger assembly on the end of a boom. A controller is configured to receive signals from a plurality of sensors distributed throughout the digging system, along the boom and the digger assembly. Based on the information from the sensors, the controller automatically adjusts one or more parameters of the digging system while digging the hole. The system and method prevent corkscrewing of the digging member, while also allowing for a specific hole depth and hole angle to be dug. Specifically, the system allows for easily and accurately digging a plumb hole.

20 Claims, 4 Drawing Sheets

AUTOMATIC DIGGING ADJUSTMENT SYSTEM AND METHOD

1. FIELD

Embodiments of the invention relate to digging systems. More specifically, embodiments of the invention relate to automatic adjustment of digging operations.

2. RELATED ART

Digger derricks are used to maintain and install utility poles by digging holes using an auger and additionally, installing screw anchors for stabilizing structures, such as utility poles. Both the holes dug for utility poles and installation of screw anchors requires relatively precise depths and angles for proper placement of and securing of utility lines. For instance, the depth of a hole dug may differ based on the composition of the soil, the climate of the area, etc. Additionally, in the case of erecting a structure, typically the hole must be substantially perpendicular to the ground level plane for proper support of the structure.

Current methods to ensure a plumb hole, a precise depth of the hole, and a precise angle of the hole are inaccurate and time consuming. For example, a common method of making sure a hole is dug perpendicular uses a plumb bob, which requires an additional worker using a weight attached to a string to "eye-ball" whether the auger is moving in a straight downward direction. Furthermore, the depth of the auger in the ground is a relative guess made by the operator or other workers. For example, in order to check the correct depth, the operator extracts the auger from the hole and another worker measures the depth using a tape measure. If the depth is incorrect (i.e., not to set specifications) then the operator must either re-insert the auger into the hole and continue digging, or workers must shovel pre-dug dirt back in the hole to decrease the depth (i.e., the hole was dug too deep). These current methods not only increase the time and effort to dig a single hole, but additionally require multiple workers to complete the task.

In addition to the aforementioned problems, current methods require the operator to be able to adjust the digging operation in real-time to prevent undesirable hazards from occurring, such as corkscrewing of the auger. Corkscrewing may occur when an operator lowers the auger too quickly, thus applying excessive down pressure on the auger. This causes the auger to screw into the soil, rather than dig through the soil as intended. Corkscrewing can negatively impact the hole being dug, and if uncorrected, can damage the digging mechanism on the derrick digger.

Therefore, there is a need for a system and method specifically designed to automatically sense and adjust the digging operation of a derrick digger to correct for angle and depth, as well as to prevent corkscrewing.

SUMMARY

Embodiments of the invention solve the above-mentioned problems by providing a system, method, and device for automatically sensing and adjusting aspects of a digging operation performed by a derrick digger, or other digging system.

An embodiment of the invention allows an operator to define a predefined hole depth, engage an automatic dig command, actuate full speed dig and full speed boom lower, and the controller will automatically dig a hole at the required angle to the specified depth. In some embodiments, the required angle is about 90 degrees perpendicular to the ground surface (i.e., a plumb hole).

In some aspects, the techniques described herein relate to a system for automatically digging a hole including: an adjustable boom including a proximal end and a distal end; a digger assembly operatively connected to the distal end of the adjustable boom, the digger assembly including a digging member operatively connected to a digger motor; a plurality of sensors disposed on the adjustable boom or the digging member; and a controller configured to receive signals from the plurality of sensors, wherein the controller is operatively linked to at least one motor or actuator for controlling one or more aspects of the adjustable boom, wherein the controller is configured to control the at least one motor based on information received from the plurality of sensors while automatically digging the hole.

In some aspects, the techniques described herein relate to a digging system for digging a hole of a predetermined angle and depth, the system including: a processor; and one or more non-transitory computer readable storage media having a computer program stored thereon for digging the hole, wherein the computer program instructs the processor to perform actions including: receiving, via a user interface, a commanded down speed of a digging member, the digging member being operatively connected to a distal end of a boom; measuring, via a pressure sensor, a pressure exerted on the digging member; calculating a corkscrew prevention including a down speed limit based on the measured pressure exerted on the digging member; approving the commanded down speed if it is less than or equal to the down speed limit; digging the hole at a specified angle; calculating one or more of a boom lower speed, a boom retraction speed, and a boom extension speed; actuating the boom based on one or more of the boom lower speed and the boom retraction/extension speed; measuring, via a digger angle sensor, an angle of the digging member; adjusting one or more digging parameters based on the measured angle of the digging member and the specified angle of the hole; and terminating the digging once a specified hole depth is reached by the digging member.

In some aspects, the techniques described herein relate to a method for digging a hole including the steps of: receiving, via a user interface, a specified depth and a specified angle for the hole; receiving, via the user interface, a commanded down speed of a digging member, the digging member being operatively connected to a distal end of a boom; measuring, via a pressure sensor, a pressure exerted on the digging member; calculating a corkscrew prevention including a down speed limit based on the pressure exerted on the digging member; approving the commanded down speed if it is less than or equal to the down speed limit; initiating digging of the hole; while digging, calculating one or more of a boom lower speed, a boom length retraction/extension speed; actuating the boom based on at least the boom lower speed and the boom length retraction/extension speed; measuring, via a digger angle sensor, an angle of the digging member; adjusting one or more digging parameters based on the measured angle of the digging member; and terminating the digging once the specified depth is reached by the digging member.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
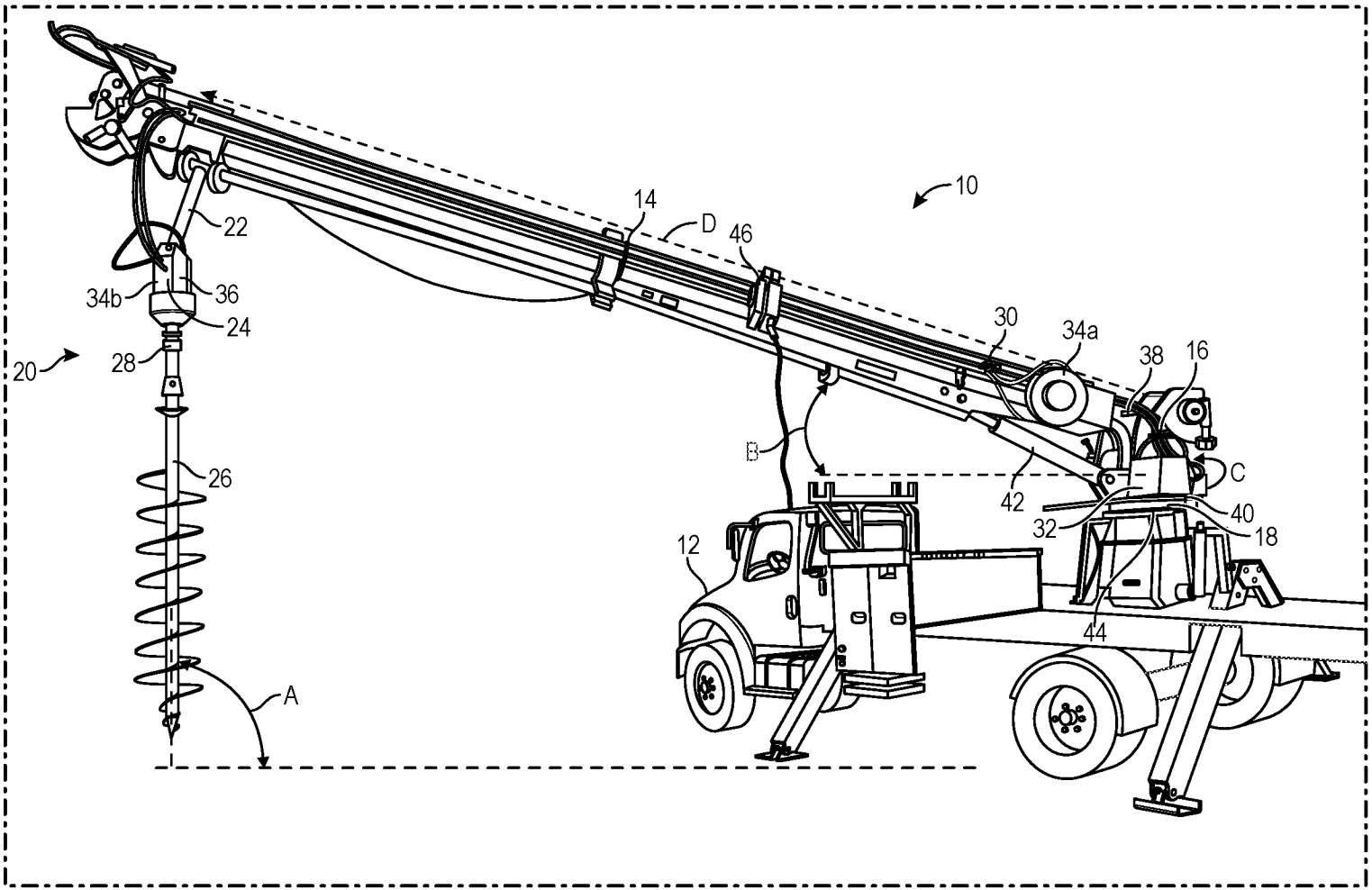
FIG. 1 is a depiction of a derrick digger system in some embodiments.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

FIG. 1 depicts a digger derrick system 10 in some embodiments. The digger derrick system 10 comprises a utility vehicle 12, a boom 14, and a digger assembly 20. The boom comprises a proximal end attached to the utility vehicle 12 at a fulcrum 16 and a swivel 18. In some embodiments, the boom 14 may be a telescoping boom or an articulating boom. In some embodiments, the boom 14 further includes a rotating linkage for rotatably attaching the digger assembly 20 to the boom 14. In some embodiments, the boom 14 further comprises a hydraulic circuit for transmitting hydraulic power and extending/retracting the boom 14. The digger assembly 20 comprises a digger motor 24 and, in some embodiments, a digging member 26. In some embodiments, digging member 26 may comprise one of an auger, a screw anchor, or any other rotational digging device. In some embodiments, the digging member 26 is secured to the digger assembly 20 using a kelly bar 22. It should be understood that in some embodiments the digger assembly 20 is not necessarily attached to the boom 14. Instead, the digger assembly 20 can be alternatively attached to a crane or any other extension or support mechanism. Furthermore, the utility vehicle 12 may comprise any of a digger derrick, a tractor, a skid steer, or any other vehicle configured to attach to digger assembly 20.

In some embodiments, the digger motor 24 of the digger assembly 20 may be operable to rotate the digging member 26 in a first direction associated with a digging operation of the digging member 26. Such rotation may be used to dig into the ground and/or to place an anchor screw. Additionally, the digger motor 24 may be operable to rotate the digging member 26 in a second direction opposite the first direction. Said second direction may be associated with an extraction operation of the digging member 26 and/or unscrewing an anchor screw from the ground. For example, during operation, the digger motor 24 rotates the digging member 26 in the first direction to dig a hole, and then rotates the digging member 26 in the second direction to remove the digging member 26 from the hole.

In some embodiments, the digger assembly 20 may be configured to dig a plumb hole. The plumb hole may, in some embodiments, be dug to erect an object from the ground. For example, the plumb hole may be configured to receive a portion of a utility pole and secure that portion therein. In some embodiments, the digger assembly 20 may be configured to dig a hole at a specified angle. In some embodiments, the digger assembly 20 may be configured to insert one or more screw anchors into the ground. The screw anchors may, in some embodiments, be used to anchor a utility pole or other structure to the ground. While not explicitly stated, it is contemplated that the digger assembly 20, and system disclosed herein, may be configured to work with any rotary system wherein one or both of the angle and depth of the rotary system must be clearly defined.

In some embodiments, the boom 14 may be configured to adjust the depth and speed of digger assembly 20 during operation. For example, boom 14 may be an articulating boom, such that movement around fulcrum 16 may adjust the angle of boom 14 compared to a substantially horizontal plane (i.e., angle B). In some embodiments, angle B may be decreased, causing digger assembly 20 to lower. For example, as angle B is decreased, the distance between digging member 26 and the ground will decrease, until eventually, digging member 26 will contact the ground. Additionally, the rate at which angle B decreases may determine the speed at which digger assembly 20 digs. Such a speed is essential for preventing corkscrewing of digging member 26. Furthermore, the angle B may be used to determine the depth of the plumb hole dug by digging member 26. For example, as angle B decreases, the distance that digging member 26 projects into the ground will increase. Currently, during a digging operation, an operator of digger assembly 20 must guess how deep digging member 26 is into the ground. This creates an inefficient system, wherein the operator has to remove digging member 26 from the plumb hole to actually measure how deep the hole is.

Additionally, in some embodiments, the boom 14 may be configured to adjust the angle of digger assembly 20 during operation. For example, boom 14 may be a telescoping boom, wherein the distance between fulcrum 16 and kelly bar 22 (i.e., distance D) may be adjusted. Adjustments of distance D while digger assembly 20 is in operation may, in turn, alter the angle at which digging member 26 is digging (i.e., angle A) into the ground. For example, while digging a plumb hole with digger assembly 20 (i.e., decreasing angle B), if distance D is not adjusted, then angle A will grow larger. In other terms, digging member 26 will begin to point towards utility vehicle 12. This may cause the hole to be dug at an incorrect angle (e.g., not straight down). To account for this, distance D may be decreased at a specific rate while digger assembly 20 is directed downwards. This, in turn, may cause digging member 26 to dig a straight plumb hole. Currently, an operator of digger assembly 20 must adjust distance D at a rate they suspect will cause digging member 26 to dig a straight plumb hole. Such guess work by the operator can often lead to angled holes, which may be undesirable, especially if using the hole to erect, for example, a utility pole.

Figure 2:
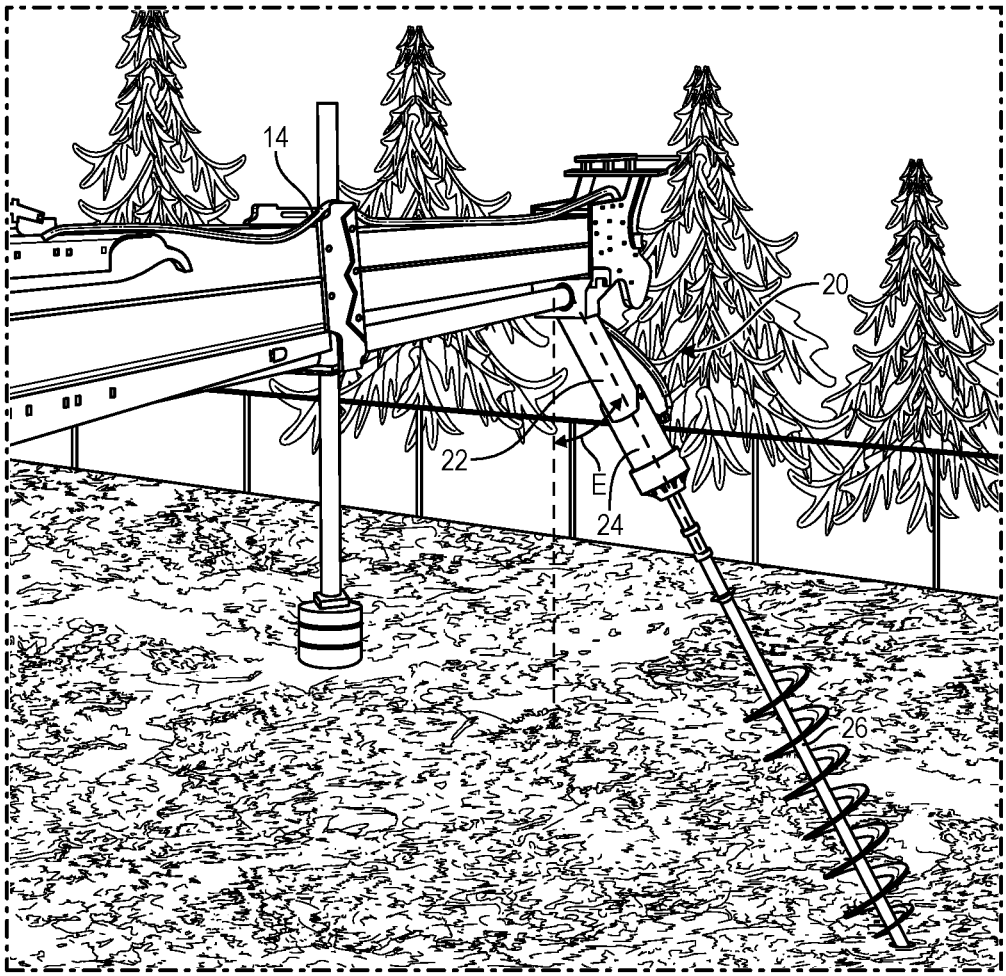
FIG. 2 is a depiction of a digging assembly in some embodiments.

In addition to adjusting angle B and distance D, boom 14 may be configured to rotate around swivel 18 in a circumferential direction around utility vehicle 12 (i.e., angle C). Rotation of boom 14 around angle C, may, in some embodiments, allow digger assembly 20 to dig an angled hole. Referring to FIG. 2, digging member 26 is depicted at an angle E away from a substantially vertical position downwards from boom 14. Angle E may occur via articulation of kelly bar 22 around the contact point with boom 14. By placing digging member 26 against the ground at angle E, digger assembly 20 may dig an angled hole. For example, angle B may be decreased to lower digging member 26 towards the ground while angle C is adjusted in the direction of angle E of digging member 26 so as to cause digging member 26 to dig an angled hole. In some embodiments, distance D may also necessitate adjustment to dig an angled hole. In some embodiments, operation of digger assembly 20 to dig a specified angled hole may be used to secure a screw anchor into the ground.

Turning back to FIG. 1, in some embodiments, digger derrick system 10 may include a plurality of sensors to sense the aforementioned angles and distances. For example, in some embodiments, digger derrick system 10 may include a boom extension sensor 30, which senses the distance D. While boom extension sensor 30 is depicted at the proximal end of boom 14, it may, in some embodiments, be located in the middle of boom 14. There may be multiple boom extension sensors 30, which may be located at any point along the boom 14. In some embodiments, boom extension sensor 30 may comprise one or more of a string pot, a linear variable differential transformer (LVDT), a linear potentiometer, or contactless measurement technologies such as laser, radar, ultrasonic, etc. In some embodiments, digger derrick system 10 may include one or more pressure sensors 32, such as an analog pressure transducer. Pressure sensor 32 may, in some embodiments, be configured to sense the pressure exerted on digger assembly 20 while in operation. For example, while the boom 14 is being lowered (i.e., decrease in angle B), and digging member 26 is digging a hole, a pressure from the ground will be exerted on digger assembly 20. Such a pressure may, in some embodiments, be communicated to a controller (e.g., controller 210 in FIG. 3) via pressure sensor 32 so as to prevent corkscrewing of the digging member 26 while digging. While pressure sensor 32 is depicted near fulcrum 16 at the base of boom 14, in some embodiments, pressure sensor 32 may be disposed near digger motor 24, or at other desired locations along the boom 14.

In some embodiments, digger derrick system 10 may include one or more angle sensors which may be used to measure angles of specific components in relation to one another or a substantially horizontal or vertical plane. For example, in some embodiments digger derrick system 10 may include digger angle sensor 36. Digger angle sensor 36 may be configured to measure the angle of the digging member 26, or a screw anchor, in relation to a substantially horizontal plane. In some embodiments, digger angle sensor 36 may comprise one of an inclinometer, a dual axis inclinometer, a rotary encoder, a rotary variable differential transformer (RVDT), or any type of linear measurement device. In some embodiments, digger angle sensor 36 may be configured to determine angle A of the digging member 26 or of a screw anchor. In some embodiments, digger angle sensor 36 may be configured to determine angle E of digging member 26 or of a screw anchor.

In some embodiments, digger derrick system 10 may include boom angle sensor 38. Boom angle sensor 38 may be configured to measure the angle of the boom 14 in relation to a substantially horizontal plane. In some embodiments, boom angle sensor 38 may comprise one of an inclinometer, a rotary encoder, a rotary variable differential transformer (RVDT), or any type of linear measurement device. In some embodiments, boom angle sensor 38 may be configured to determine angle B of the boom 14.

In some embodiments, digger derrick system 10 may include a boom rotational angle sensor 40. Boom rotational angle sensor 40 may be configured to measure the rotational angle of the boom 14 around its pivot axis (i.e., angle C). In some embodiments, boom rotational angle sensor 40 may comprise one of an inclinometer, a rotary encoder, or a rotary variable differential transformer (RVDT).

In some embodiments, digger derrick system 10 includes a plurality of motors or actuators throughout for controlling movement of different components. For example, in some embodiments, digger derrick system 10 may include a boom angle motor or actuator 42. Boom angle motor or actuator 42 may be configured to control the angle of boom 14 around fulcrum 16 in relation to a substantially horizontal plane (i.e., angle B). In some embodiments, digger derrick system 10 may include a boom rotational motor 44. Boom rotational motor 44 may be configured to rotate boom 14 around swivel 18 (i.e., angle C). In some embodiments, digger derrick system 10 may include a boom extension motor or actuator 46. Boom extension motor or actuator 46 may be configured to extend and/or retract boom 14 (i.e., distance D). As mentioned previously, in some embodiments, digger derrick system 10 includes digger motor 24. Digger motor 24 may be configured to rotate digging member 26, or other digging components, in a specific direction (i.e., clockwise, or counterclockwise) as well as control the speed of rotation. In some embodiments, the plurality of motors may be communicatively linked to a controller (e.g., controller 210, FIG. 3). In some embodiments, the plurality of motors may comprise one or more of hydraulic cylinder motors, pneumatic motors, electronic motors, rotary actuators, etc. In some embodiments, one motor may be used to provide power to multiple parts.

In some embodiments, data from the plurality of sensors of digger derrick system 10 may be communicated to a controller (e.g., controller 210, FIG. 3) to determine specific characteristics of the digger derrick system 10, therein allowing controller 210 to execute a specified digging operation via the plurality of motors or actuators. These processes will be discussed in further detail below.

Figure 3:
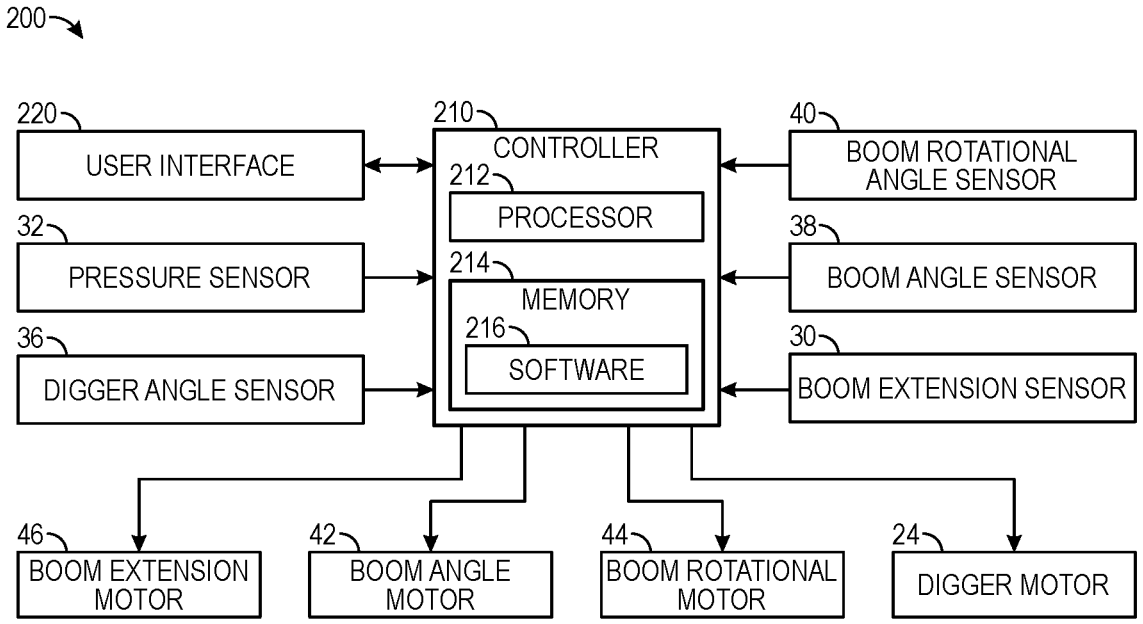
FIG. 3 is a block diagram illustrating a control architecture for controlling various components of the derrick digger system, in some embodiments.

FIG. 3 shows an exemplary control architecture 200 for controlling the digging of a hole, or other digging operations, using the digger derrick system 10. Control architecture 200 includes a controller 210 communicatively coupled to the devices of digger derrick system 10. The devices may include components of digger derrick system 10, including the boom extension sensor 30, pressure sensor 32, digger angle sensor 36, boom angle sensor 38, boom rotational angle sensor 40, boom angle motor or actuator 42, boom rotational motor 44, boom extension motor or actuator 46, and digger motor 24. Controller 210 may be a microcontroller, a microprocessor, or programmable logic controller (PLC). In some embodiments, controller 210 may be a computer (e.g., a digger derrick computer or a separate computer), having a memory 214, including a non-transitory computer-readable medium for storing software 216, and a processor 212 for executing instructions of software 216. In certain embodiments, some, or all of software 216 is configured as firmware for providing low-level control of devices of the digger derrick system 10. Communication between controller 210 and devices of digger derrick system 10 may be by one of a wired and/or wireless communication media. Additionally, communication between controller 210 and devices of digger derrick system 10 may be connected via a cable reel, which could provide a means of wired communication to sensors and/or motors across the translating portion of boom 14.

Memory 214 may be capable of storing or retaining a computer program and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, optical storage media such as compact discs (CDs or CDROMs), digital video disc (DVD), and the like, or combinations thereof.

The controller 210 of embodiments of the present teachings may be responsive to user input via user interface 220. As defined herein, user interface 220 may comprise a variety of computing devices including, but not limited to, the following: desktops, laptops, telephones, smartphones, tablets, keyboards, keypads, mic, trackpads, trackballs, pen-input devices, printers, scanners, facsimile, touchscreens, network transmissions, verbal/vocal commands, gestures, button presses, lever presses, or the like.

Controller 210 may execute control algorithms that include a feedback mechanism that depends on a difference or error term between a specified speed and a measured speed from one or more of the extension, angle, and/or rotation of boom 14 as well as the angle of digger assembly 20. In some embodiments, the controller 210 includes a proportional-integral-derivative (PID) control algorithm in which the proportional term adjusts the position of the boom in proportion to the magnitude of the error term, the integral term adjusts the position of the boom in proportion to both the magnitude and the duration of the error term by integrating over time to account for any cumulative error, and the derivative term adjusts the position of the boom in proportion to the rate of change of the error term over time. The terms are weighted based on gains (e.g., coefficients), which may be tuned to provide a stable boom/digger assembly position with a minimal error term. In some embodiments, the controller 210 may be a proportional-integral (PI) controller in which the derivative term is not used (e.g., set to zero). In some embodiments, the controller 210 may be a proportional (P) controller in which the derivative term and the integral term are not used. In certain embodiments, the boom 14 and/or digger assembly 20 position feedback may be used as a surrogate for rate feedback (e.g., derivative controller action).

In some embodiments, the controller 210 reduces the error term based on feedback from the boom extension sensor 30, the pressure sensor 32, the boom angle sensor 38, the boom rotational angle sensor 40, and the digger angle sensor 36, which may be used to improve performance of the control architecture 200.

An exemplary equation for determining the dig parameters is as follows:

$$V_i = \frac{V_d \sin\theta_d}{\cos\theta_b} + \tan\theta_b \frac{V_d \cos\theta_d \cdot - V_d \sin\theta_d \cdot \tan\theta_b}{\sin\theta_b \tan\theta_b + \cos\theta_b}$$

$$V_b = \frac{V_d \cos\theta_d \cdot - V_d \sin\theta_d \tan\theta_b}{L_b(\sin\theta_b \tan\theta_b + \cos\theta_b)}$$

where $V_i$ is velocity of boom extension, $V_b$ is velocity of boom raise/lower, $V_d$ is the vertical velocity of digging member 26, $\theta_d$ is the angle A as discussed above, $\theta_b$ is the angle B as discussed above, and $L_b$ is the distance D as discussed above. These equations control the change in boom 14 geometry required to ensure a plumb hole and consistent digging radius, which is the distance from the utility vehicle 12 to the hole location, throughout the entire digging process. Within the plumb dig calculation algorithms $\theta_d$ will be driven to 90° with the logic attempting to maintain this in order to keep the digging member 26 plumb.

Communication between controller 210, user interface 220, or devices of digger derrick system 10 may include mobile communication devices (including wireless devices), workstations, desktop computers, laptop computers, palmtop computers, tablet computers, portable digital assistants (PDA), smart phones, smart watches, other smart wearables, and the like, or combinations thereof. Various embodiments of the user interface 220 may also include voice communication devices, such as cell phones and/or smart phones. In some embodiments, the user interface 220 may have an electronic display operable to display visual graphics, images, text, etc. In certain embodiments, the user interface 220 facilitates interaction and communication through a graphical user interface (GUI) that is displayed via the electronic display. The GUI enables the user to interact with the electronic display by touching or pointing at display areas to provide information to the system.

User interface 220, may, in some embodiments, allow for a user to input a specified angle and/or depth of a hole or placement of a screw anchor. In some embodiments, user interface 220 may allow a user to input a specified location for the hole in relation to utility vehicle 12. In some embodiments, controller 210 may perform specific functions using components of digger derrick system 10 to meet the specified input received from user interface 220. In some embodiments, controller 210 may provide feedback to user interface 220 to notify a user of operations occurring. For example, controller 210 may notify a user via user interface 220 that unexpected terrain (i.e., a boulder) has been reached by digging member 26. In another example, controller 210 may notify a user via user interface 220 that digging member 26 is at risk of corkscrewing unless otherwise acted upon to prevent such an occurrence. User interface 220 may include a variety of notification methods to notify a user of specific operations of digger derrick system 10, including, but not limited to, the following: audio signal, visual signal, display on a screen, tactile stimuli, operational overrides, or combinations thereof.

Controller 210 may receive input from the plurality of sensors displaced throughout digger derrick system 10 to receive specific information regarding operation of digger derrick system 10. For example, in some embodiments, controller 210 may receive input from one or more pressure sensors 32. Information received from pressure sensors 32 may provide controller 210 with data regarding the pressure on digger assembly 20 caused by the reaction of the ground to the rotating motion while performing a digging operation. In some embodiments, controller 210 may use this information to determine the speed at which digger assembly 20 should be moved in a downward direction (i.e., speed at which to dig). For example, if pressure on digger assembly 20 is too great, the digger assembly 20 may begin to exhibit corkscrewing. If pressure on digger assembly 20 is too little, the digger assembly 20 may not be efficiently digging a hole. Accordingly, controller 210 may comprise a specific range of pressures, for example a database stored in memory 214, which is acceptable for a digging function. Controller 210 may be configured to maintain a certain pressure on digger assembly 20 throughout a digging operation. In some embodiments, controller 210 may maintain a specific pressure on digger assembly 20 by controlling the actuation of boom 14 along angle B by, for example, controlling the angle of boom 14 via boom angle motor or actuator 42. In some embodiments, controller 210 may be configured to substantially slow down or terminate the velocity of boom 14 downwards (i.e., alter the decrease in angle B) if digger reaction pressure exceeds a predetermined threshold. For example, controller 210 may determine via input from pressure sensor 32 that the pressure on digger assembly 20 is above the predetermined threshold. Based on this determination, controller 210 may instruct digger motor 24 to slow down or reverse rotation of digger assembly 20 (i.e., reverse to counterclockwise). In some embodiments, the downward speed of digger assembly 20 may be established by an operator of digger derrick system 10 (e.g., by actuation of a lever or other action on user interface 220). In these embodiments, controller 210 may automatically override the downward speed set by the operator in the case that reaction pressure sensed by pressure sensor 32 surpasses a predetermined threshold. Controller 210 may, in some embodiments, instruct an increased angle B of boom 14 via boom angle motor or actuator 42 (i.e., raise digger assembly 20). In this example, controller 210 may perform these or other operations to prevent corkscrewing of digging member 26.

In some embodiments, controller 210 may sense the angle of the digger assembly via digger angle sensor 36. In some embodiments, data from digger angle sensor 36 may include information on the angle A of digging member 26. In some embodiments, data from digger angle sensor 36 may include information on the angle E of digging member 26. In some embodiments, controller 210 may use data from digger angle sensor 36 to determine the rate at which to retract or extend boom 14 during a digging operation. For example, during a digging operation, controller 210 may receive data from digger angle sensor 36 that angle A is 95 degrees, which the controller 210 determines has deviated 5 degrees from the specified angle of 90 degrees. To compensate for this, controller 210, via boom extension motor or actuator 46, may retract boom 14 at a determined rate so as to correct for the 5 degree offset of digging member 26. In some embodiments, controller 210 may use data stored in memory 214 to determine the rate at which to retract boom 14. In another example, during a digging operation, controller 210 may receive data from digger angle sensor 36 that angle E is 45 degrees, which the controller 210 determines has deviated 10 degrees from the specified angle of 35 degrees (e.g., when inserting a screw anchor). To compensate for this, controller 210, via boom rotational motor 44, may rotate boom 14 at a determined rate and angle (i.e., around angle A) so as to correct for the 10 degree offset of digging member 26. In some embodiments, controller 210 may alter other aspects of digger derrick system 10, for example angle B of boom 14, to compensate for an offset angle E.

In some embodiments, controller 210 may receive data regarding boom rotational angle via boom rotational angle sensor 40. Controller 210 may use data from boom rotational angle sensor 40 information to, for example, secure a screw anchor into the ground at an angle offset from substantially vertical (e.g., angle E of 30 degrees). In some embodiments, controller 210 may receive data from boom rotational angle sensor 40 while securing a screw anchor in real-time, such that controller 210 may rotate boom 14 via boom rotational motor 44 so as to maintain the specified angle of the screw anchor while securing it to the ground.

In some embodiments, controller 210 may receive data regarding the boom angle from boom angle sensor 38. Controller 210 may use data from boom angle sensor 38 to, for example, drive digger assembly 20 downwards while digging a hole to a specific depth. For example, in some embodiments, controller 210 may receive data from boom angle sensor 38 that angle B is about 20 degrees. Controller 210 may determine, via memory 214, that an angle B of 20 degrees suggests that digging member 26 is about five feet into the ground. Controller 210 may then adjust the angle of boom 14, via boom angle motor or actuator 42, to continue decreasing to an angle B of about 10 degrees. Controller 210 may determine, via memory 214, that an angle B of 10 degrees generates a hole of about eight feet deep, which, in this example, may be the specified depth of the hole.

In some embodiments, controller 210 may receive data regarding the extension length of boom 14 (i.e., distance D) via boom extension sensor 30. Controller 210 may use data from boom extension sensor 30 to determine if distance D matches the calculated length needed to keep digger assembly 20 vertical throughout a digging operation. For example, controller 210 via memory 214 may determine that the distance D should decrease at a rate of 1 foot per every 5 degrees decrease in angle B to dig a straight hole. During digging operation, controller 210 may receive substantially real-time data from boom extension sensor 30 on distance D to confirm that distance D matches the calculated length necessary for the plumb hole.

While examples are given above for operation of exemplary control architecture 200, these are not to be construed as limiting examples of operations. It will be clear to a person skilled in the art that controller 210 may receive and use data from any one or more sensors disclosed herein to determine how to adjust any one or more outputs disclosed herein to obtain a specified digging outcome.

Figure 4:
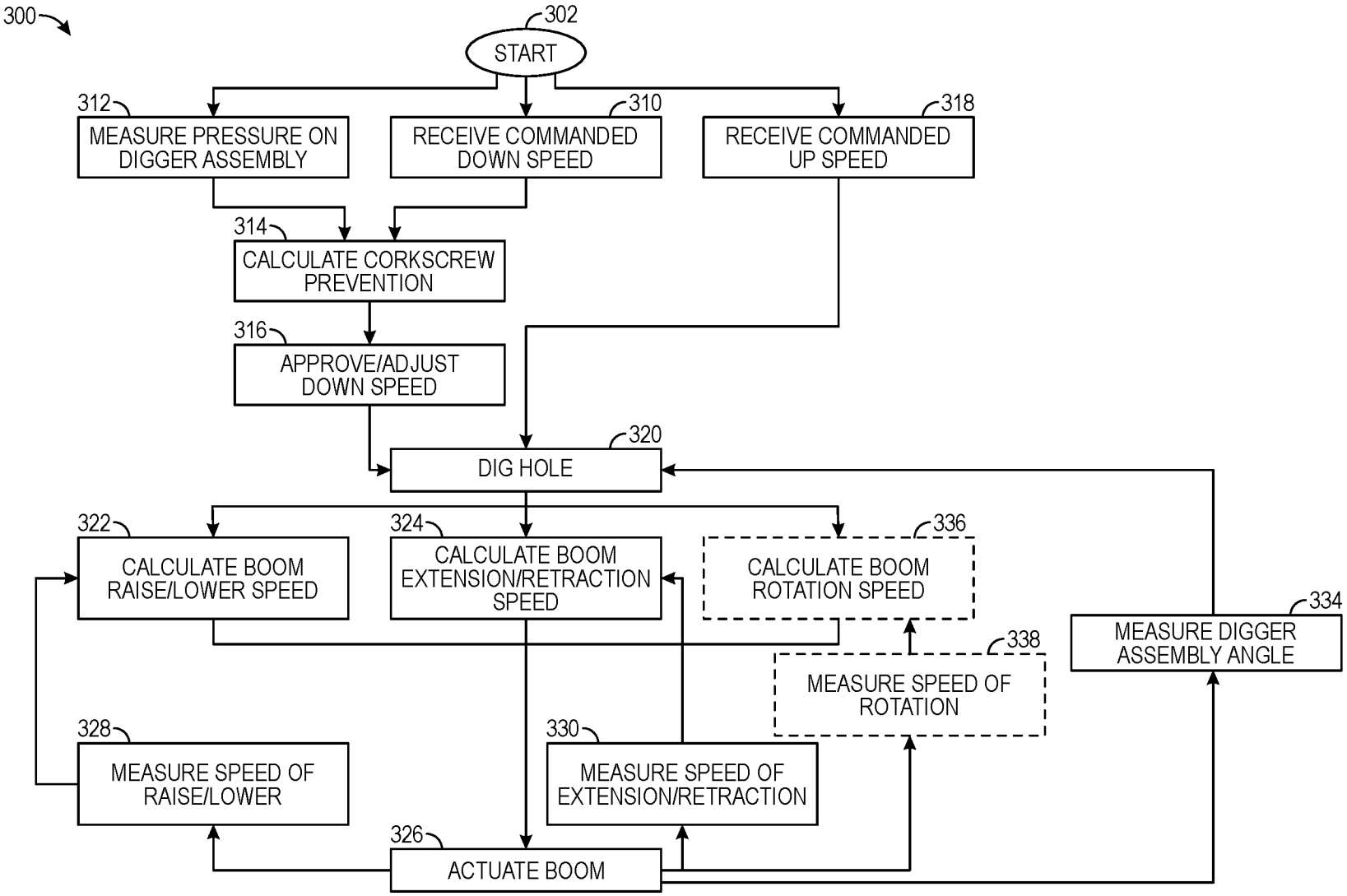
FIG. 4 is a process-flow diagram illustrating an automatic digging method, in some embodiments.

FIG. 4 is a process flow diagram illustrating an exemplary automatic digging method 300 in an embodiment, performed using, for example, the digger derrick system 10 of FIGS. 1-2.

In a step 302, the automatic digging method 300 starts. In an example of step 302, an operator may instruct the digger derrick system 10 to start digging via user interface 220. In some embodiments, this may be done once the distal end of the digging member 26 is adjacent the ground. This may provide controller 210 with a set point to measure from to, for example, measure the depth of the hole. In other embodiments, the automatic digging method 300 may be started by an operator pressing down a button or lever. Such a button or lever may provide a safety mechanism, wherein the controller 210 may continue the automatic digging method 300 as long as the button or lever is pressed. Accordingly, if the operator determined something had gone awry during the digging operation, they may release or otherwise change the button or lever so as to indicate to the controller 210 to immediately halt all operation.

In a step 310, the commanded down speed is received. In an example of step 310, a user may input via the user interface 220 to adjust the boom 14 downwards at a rate of one foot per minute to, for example, dig a plumb hole. Controller 210 may receive this command. Automatic digging method 300 may then proceed to step 312. Alternatively, step 312 may occur simultaneously with or before and/or after step 310.

In a step 312, the pressure on the digger assembly is measured. In an example of step 312, controller 210, via pressure sensor 32, measures the pressure exerted on digger assembly 20. This pressure may be a function of one or more of the ground composition (e.g., clay, dirt, mud, sand, etc.), the downward speed of boom 14, the rotation speed of digger assembly 20, or other factors. Automatic digging method may then proceed to step 314.

In a step 314, the corkscrew prevention parameters are calculated. In an example of step 314, controller 210, using input received from steps 310 and 312, calculates whether the commanded down speed from step 310 will cause corkscrewing of digger assembly 20 based on the pressure input received in step 312. In some embodiments, controller 210 may comprise predetermined approved down speeds of boom 14 based on specific pressures exerted on digger assembly 20. For example, controller 210 may receive the pressure exerted on digger assembly 20 from pressure sensor 32. Based on this measured pressure, controller 210 may, using memory 214, determine the maximum down speed approved for boom 14. Automatic digging method 300 may then proceed to step 316.

In a step 316, the down speed is either approved and maintained or adjusted. In an example of step 316, controller 210, based on calculations in step 314, either approves of the commanded down speed received in step 310 or adjusts the down speed to prevent corkscrewing. For example, in some embodiments, controller 210, based on memory 214, determines that the pressure exerted on digger assembly 20 allows for a specific down speed of boom 14. Controller 210 may then compare the down speed commanded in step 310 with the calculated approved down speed. If controller 210 determines the commanded down speed exceeds the approved down speed, then controller 210, may, in some embodiments, automatically adjust the down speed of boom 14 so as to prevent corkscrewing of digger assembly 20 or halt the digging. If controller 210 determines the commanded down speed does not exceed the approved down speed, then controller 210, may, in some embodiments, approve the down speed of boom 14 and proceed to step 320. In some embodiments, if controller 210 determines that the commanded down speed does not exceed the approved down speed, controller 210 may automatically increase the down speed of boom 14 via boom angle motor or actuator 42 to match the approved down speed. In some embodiments, if controller 210 determines the commanded down speed does not exceed the approved down speed of boom 14, controller 210 may alert the user, via user interface 220, that down speed of boom 14 may be increased. In some embodiments, controller 210 may alert a user via audible noises, visual displays, or the like. In some embodiments, steps 310, 312, 314, and 316 may be performed continuously, or at a set rate (i.e., once a second) throughout a digging operation so as to adjust for alterations on the pressure exerted on digger assembly 20.

In a step 318, a commanded up speed may be received. In an example of step 318, controller 210 may receive a command via user interface 220, to raise boom 14. In some embodiments, raising boom 14 and thus digger assembly 20, may allow for removal of dirt. In some embodiments, a user may command an up operation of digger assembly 20 based on unforeseen circumstances (e.g., digger assembly 20 running into underground structures). In some embodiments, step 318 may be configured to override other steps of automatic digging method 300.

In a step 320, a hole may be dug. In an example of step 320, controller 210, based on input from step 316, may begin to dig a hole by operating digger assembly 20. For example, controller 210 may instruct digger motor 24 to begin rotation of digger assembly 20 at a specific speed and direction. In some embodiments, an operator may instruct digger motor 24 to begin rotation of digger assembly 20. Controller 210 may, in some embodiments, instruct downward direction of boom 14 via boom angle motor or actuator 42. In some embodiments, controller 210 may monitor one or more sensors while performing step 320, which is explained more fully below.

In a step 322, the raise or lower speed of the boom may be calculated. In an example of step 322, controller 210 may determine the speed at which to lower boom 14 to dig a hole at a specified angle, such as vertically. In another example of step 322, controller 210 may determine, via one or more sensors, that the hole is at the specified depth. In some embodiments, controller 210 may determine the speed at which to raise boom 14 to complete the process of digging the hole.

In a step 324, the extension or retraction rate of the boom 14 may be calculated. In an example of step 324, the controller 210 may calculate the required retraction speed of boom 14 to maintain a straight digging operation via digger assembly 20.

In a step 326, the boom may be actuated. In an example of step 326, the controller 210 may actuate the boom 14 in one or both of the up/down direction (i.e., angle B) or the extend/retract direction (i.e., distance D) based on the calculations from step 322 and step 324, respectively. Controller 210 may, in some embodiments, actuate boom 14 in the downwards direction via boom angle motor or actuator 42 at the speed calculated in step 322. In some embodiments, controller 210 may retract boom 14 via boom extension motor or actuator 46 at the speed calculated in step 324. In some embodiments, controller 210 may perform both operations simultaneously so as to maintain the specified angle of digger assembly 20. In some embodiments, controller 210 may continually perform steps 322, 324, 326, 328, and 330 to adjust one or both of the boom angle (i.e., angle B) or the boom length (i.e., distance D). In some embodiments, controller 210 may also perform steps 336 and 338 to adjust the digger angle (i.e., angle E). In some embodiments, both the length and angle of boom 14 may be co-dependent for digging a hole. For example, as angle B decreases, distance D may also need to decrease to maintain digging member 26 straight down (i.e., angle A at about ninety degrees). Accordingly, automatic digging method 300 may perform the aforementioned steps in real-time to constantly calculate, update, and adjust the digging operation as needed.

In a step 328, the speed of raising or lowering the boom may be measured. In an example of step 328, controller 210, via boom angle sensor 38, may determine the speed at which digger assembly 20 is being lowered based on the rate at which angle B is changing. In some embodiments, controller 210 may compare the measured rate from step 328 against the calculated rate from step 322 to produce an error term. If the error term of the rate of raising or lowering the boom 14 is greater than a predetermined absolute value, then automatic digging method 300 proceeds back to step 322. By proceeding back to step 322, the controller 210 forms a closed control loop in which steps 322, 326, and 328 are repeated to adjust the raise/lower speed of the boom 14 until the error term is below a predetermined value. The closed control loop may be a PID control loop, in some embodiments. In some embodiments, the closed control loop may be a PI control loop. In some embodiments, the closed control loop may be a P control loop.

In a step 330, the speed of extension or retraction of the boom is measured. In an example of step 330, the controller 210, via the boom extension sensor 30, may measure the rate at which the boom 14 is extending or retracting based on the rate of change in distance a. In some embodiments, controller 210 may compare the measured rate from step 330 against the calculated rate from step 324 to produce an error term. If the error term of the rate of extension or retraction of the boom 14 is greater than a predetermined absolute value, then automatic digging method 300 proceeds back to step 324. By proceeding back to step 324, the controller 210 forms a closed control loop in which steps 324, 326, and 330 are repeated to adjust the extension/retraction speed of boom 14 until the error term is below a predetermined value. The closed control loop may be a PID control loop, in some embodiments. In some embodiments, the closed control loop may be a PI control loop. In some embodiments, the closed control loop may be a P control loop.

In a step 334, the auger angle is measured. In an example of step 334, controller 210, via the digger angle sensor 36, may determine the angle of digger assembly 20. This may include one or both of angle A and angle E of digger assembly 20. In some embodiments, controller 210 may compare the measured angle from step 334 against the specified angle (e.g., angle inputted by a user at step 302) to produce an error term. If the error term of the angle of digger assembly 20 is greater than a predetermined absolute value, then automatic digging method 300 proceeds back to step 320. By proceeding back to step 320, the controller 210 forms a closed control loop in which steps 322, 324, 326, 328, 330, and 334 are repeated to adjust the extension/retraction speed of boom 14 as well as the raising/lowering speed of boom 14 until the error term of the angle of the digger assembly 20 is below a predetermined value. The closed control loop may be a PID control loop, in some embodiments. In some embodiments, the closed control loop may be a PI control loop. In some embodiments, the closed control loop may be a P control loop.

In an optional step 336, the boom rotation speed is calculated. In an example of step 336, controller 210 calculates that the boom 14 must rotate at a specific speed to cause digger assembly 20 to dig at a specified angle offset from substantially vertical (i.e., angle E≠0 degrees). Controller 210, at step 326, may then rotate boom 14 at the calculated speed via boom rotational motor 44.

In an optional step 338, the boom rotation speed is measured. In an example of step 338, controller 210, via boom rotational angle sensor 40, measures the speed at which the boom 14 is rotating (i.e., rate of change of angle C). In some embodiments, controller 210 may determine an error term between the calculated rotational speed and the measured rotational speed. If the error term of the rotational speed of boom 14 is greater than a predetermined absolute value, then automatic digging method 300 proceeds back to step 336. By proceeding back to step 336, the controller 210 forms a closed control loop in which steps 326, 338, and 336 are repeated to adjust the rotational speed of boom 14 until the error term of the rotational speed is below a predetermined value. The closed control loop may be a PID control loop, in some embodiments. In some embodiments, the closed control loop may be a PI control loop. In some embodiments, the closed control loop may be a P control loop.

The automatic digging method 300 may repeat continuously or on a predetermined schedule (e.g., once every 20 msec, once every 100 msec, once a second, etc.) to dig a hole at a specified angle and depth.

Automatic digging method 300 greatly improves the efficiency of digging a hole by precisely calculating the correct coordinates and speeds at which components of digger derrick system 10 should be moving to obtain a variety of specified hole depths and angles. As mentioned above, current methods rely on an operator of a digger derrick system 10 to essentially guess at what rates to adjust different components of the system to obtain certain hole parameters. This can lead to errors in both the depth and angle of the hole, as well as cause potential damage to the structures supporting the digger assembly. Additionally, automatic digging method 300 provides specific calculations for corkscrew prevention and may constantly monitor a digging operation to adjust components of digger derrick system 10 to adjust if corkscrewing may happen.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A digging system for digging a hole of a predetermined angle and depth, the system comprising:

a boom;

a digging member operatively connected to a distal end of the boom;

at least one processor; and one or more non-transitory computer readable storage media having a computer program stored thereon, wherein the computer program instructs the at least one processor to perform actions comprising:

receiving a commanded down speed of a digging member;

receiving a pressure exerted on the digging member as measured by a pressure sensor;

calculating a corkscrew prevention comprising a down speed limit based on the pressure exerted on the digging member;

approving the commanded down speed if it is less than or equal to the down speed limit;

identifying a specified angle at which the hole is to be dug;

identifying one or more of a boom lower speed, a boom retraction speed, or a boom extension speed;

actuating the boom based on one or more of the boom lower speed, the boom retraction speed, or the boom extension speed to thereby dig the hole;

receiving an angle of the digging member as measured by a digger angle sensor;

adjusting one or more digging parameters based on the angle of the digging member and the specified angle at which the hole is to be dug; and providing information that a specified hole depth has been reached by the digging member.

2. The digging system of claim 1, further comprising the actions:

receiving a lowering speed of the boom as measured by a boom angle sensor; and identifying the boom lower speed if not previously identified, or identifying the boom lower speed if previously identified, based on the lowering speed of the boom.

3. The digging system of claim 1, further comprising the actions:

receiving a retracting speed of the boom or an extending speed of the boom as measured by a boom extension sensor; and identifying one or both of the boom retraction speed or the boom extension speed if not previously identified, or identifying one or both of the boom retraction speed or the boom extension speed if previously identified, based on the retracting speed of the boom or the extending speed of the boom.

4. The digging system of claim 1, wherein the system is configured to override the commanded down speed if the commanded down speed becomes greater than the down speed limit.

5. The digging system of claim 1, wherein the specified angle of the hole is about 90 degrees relative to a ground surface.

6. The digging system of claim 1, further comprising the actions:

identifying a boom rotation speed;

receiving a rotational speed of the boom as measured by a boom rotational angle sensor; and identifying an adjusted boom rotation speed based on the rotational speed of the boom.

7. The digging system of claim 1, wherein the one or more digging parameters comprises one or more of a boom extension, a boom retraction, a boom angle relative to a ground surface, or a boom rotational angle.

8. A method for digging a hole comprising the steps of:

receiving a specified depth and a specified angle for the hole;

receiving a commanded down speed of a digging member, said digging member being operatively connected to a distal end of a boom;

receiving information indicative of a pressure exerted on the digging member;

calculating a corkscrew prevention comprising a down speed limit based on the pressure exerted on the digging member;

approving the commanded down speed if it is less than or equal to the down speed limit;

initiating digging of the hole;

while digging, identifying one or more of a boom lower speed, a boom length retraction speed, or a boom length extension speed;

actuating the boom based on at least one of the boom lower speed, the boom length retraction speed, or the boom length extension speed;

receiving information indicative of an angle of the digging member;

adjusting one or more digging parameters based on the angle of the digging member; and providing information that the specified depth has been reached by the digging member.

9. The method of claim 8, wherein the one or more digging parameters comprises one or more of a boom length extension, a boom length retraction, a boom angle relative to a ground surface, or a boom rotational angle.

10. The method of claim 8, wherein adjusting one or more digging parameters comprises adjusting a boom length extension or a boom length retraction.

11. The method of claim 8, wherein adjusting one or more digging parameters comprises adjusting a boom angle relative to a ground surface.

12. The method of claim 8, wherein adjusting one or more digging parameters comprises adjusting a boom rotational angle.

13. The method of claim 8, further comprising:

identifying a boom rotation speed based on the specified angle;

receiving information indicative of a rotational speed of the boom; and identifying an adjusted boom rotation speed based on the received information indicative of the rotational speed of the boom.

14. One or more non-transitory computer-readable media storing computer-executable instructions that, when executed by at least one processor, perform a method for digging a hole, the method comprising:

receiving a commanded down speed of a digging member, said digging member being operatively connected to a distal end of a boom;

receiving a pressure exerted on the digging member as measured by a pressure sensor;

identifying a specified angle at which the hole is to be dug;

identifying one or more of a boom lower speed, a boom retraction speed, or a boom extension speed;

instructing actuation of the boom based on one or more of the boom lower speed, the boom retraction speed, or the boom extension speed to thereby dig the hole; and providing information that a specified hole depth has been reached by the digging member.

15. The one or more non-transitory computer-readable media of claim 14, further comprising:

receiving an angle of the digging member as measured by a digger angle sensor; and adjusting one or more digging parameters based on the angle of the digging member and the specified angle at which the hole is to be dug.

16. The one or more non-transitory computer-readable media of claim 15, further comprising:

calculating a corkscrew prevention comprising a down speed limit based on the pressure exerted on the digging member; and approving the commanded down speed if it is less than or equal to the down speed limit.

17. The one or more non-transitory computer-readable media of claim 16, wherein the one or more digging parameters comprises one or more of a boom length extension, a boom length retraction, a boom angle relative to a ground surface, or a boom rotational angle.

18. The one or more non-transitory computer-readable media of claim 17, wherein adjusting one or more digging parameters comprises adjusting the boom length extension or the boom length retraction.

19. The one or more non-transitory computer-readable media of claim 18, wherein adjusting one or more digging parameters further comprises adjusting the boom rotational angle.

20. The one or more non-transitory computer-readable media of claim 14, further comprising:

identifying a boom rotation speed based on the specified angle;

receiving information indicative of a rotational speed of the boom; and identifying an adjusted boom rotation speed based on the received information indicative of the rotational speed of the boom.

* * * * *